United States Patent [19]

Yamanaka et al.

[11] Patent Number: 5,000,004

[45] Date of Patent: Mar. 19, 1991

[54] GAS TURBINE COMBUSTOR

[75] Inventors: Susumu Yamanaka, Kawasaki; Tomiaki Furuya, Yokohama; Terunobu Hayata, Kawasaki; Junji Koezuka, Yokohama; Katsuhei Tanemura, Ichikawa; Akio Ohkoshi, Abiko; Yukiyoshi Hara, Ageo; Hitoshi Tominaga, Yokohama; Susumu Handa, Tokyo, all of Japan

[73] Assignees: Kabushiki Kaisha Toshiba, Kawasaki; The Tokyo Electric Power Co., Inc., Tokyo, both of Japan

[21] Appl. No.: 391,312

[22] Filed: Aug. 9, 1989

[30] Foreign Application Priority Data

Aug. 16, 1988 [JP] Japan ..... 63-202789
Feb. 15, 1989 [JP] Japan ..... 1-33811

[51] Int. Cl.[5] ..... F02C 7/26; F02C 3/22

[52] U.S. Cl. ..... 60/723; 60/738; 60/739; 431/7

[58] Field of Search ..... 60/723, 737, 742, 743, 60/740, 739, 738, 749; 239/533.2, 434.5; 431/7, 328

[56] References Cited

U.S. PATENT DOCUMENTS

| | | | |
|---|---|---|---|
| 2,705,869 | 4/1955 | Johnstone | 60/738 |
| 3,943,705 | 3/1976 | Decorso et al. | 60/723 |
| 4,047,877 | 9/1977 | Flanagan | 60/723 |
| 4,262,482 | 4/1981 | Roffe et al. | 60/738 |
| 4,731,989 | 3/1988 | Furuya et al. | 431/7 |
| 4,845,952 | 7/1989 | Beebe | 60/723 |

FOREIGN PATENT DOCUMENTS

| | | | |
|---|---|---|---|
| 1191703 | 8/1985 | Canada | 60/723 |
| 144094 | 6/1985 | European Pat. Off. . | |
| 2042364 | 6/1971 | Fed. Rep. of Germany . | |

OTHER PUBLICATIONS

Tokyo International Gas Turbine Congress III-53-60, "Design and Test of Catalytic Combustor Fuel-Air Preparation System"; Beebe et al., 1987.

*Primary Examiner*—Louis J. Casaregola
*Assistant Examiner*—Timothy S. Thorpe
*Attorney, Agent, or Firm*—Oblon, Spivak, McClelland, Maier & Neustadt

[57] ABSTRACT

A gas trubine combustor includes a main body with a combustion portion into which mixture of fuel and air is supplied. The gas mixture is burned through a catalytic reaction at a catalyst body arranged in the main body. The gas mixture passed through the catalyst body is introduced into a gas phase combustion portion provided in the main body. Between the catalyst body and the gas phase combustion portion is arranged a dividing unit which has a plurality of branch passages. The gas mixture passed through the catalyst body is divided by the dividing unit into a plurality of gas streams flowing through the branch passages. Each of the gas streams is mixed with fuel supplied from a fuel supply tube.

13 Claims, 7 Drawing Sheets

GAS TURBINE COMBUSTOR

BACKGROUND OF THE INVENTION

1. Field of the Invention

This invention relates to a gas turbine combustor for use in a gas turbine power generating system and the like, and in particular to a gas turbine combustor provided with a catalyst which suppresses the generation of nitrogen oxides (NOx) as environmental pollutants.

2. Description of the Related Art

Recently, as petroleum resources have decreased, not only various alternative energy sources, but also effective use of such energy sources, are required. In order to meet these requirements, cycle power generating systems using the combination of gas turbines and steam turbines, and cycle power generating systems using the combination of coal-gasification gas turbines and a steam turbines are being developed.

These cycle power generating systems each using the combination of a gas turbine and a steam turbine have a higher power generating efficiency than the conventional generating systems employing steam turbines operated by fossil fuels, and they are expected to be viable power generating systems for efficiently converting such fuels as natural gas and coal gas, whose production is expected to increase further, into electric power.

With the conventional gas turbine combustor used in such a gas turbine power generating system, the mixture of fuel and gas containing oxygen (generally air, and hereinafter referred to as "air") is ignited by a spark plug or the like and combusted uniformly. Generally, in this type of combustor, the fuel injected from a fuel nozzle into the inner tube of the combustor is mixed with air for combustion, fed under pressure from the air duct, ignited by the spark plug, and combusted. Cooling air and diluent air are added to the resultant gas, namely the combustion gas, in order to lower its temperature to a predetermined turbine inlet temperature. Thereafter, the thus-cooled and diluted combustion gas is injected through a turbine nozzle into a gas turbine.

One of the most serious problems which occurs in this conventional gas turbine combustor is that, a great deal of NOx is produced upon combustion of the fuel, thereby causing environmental pollution. This occurrence of NOx is attributed to the development of a localized high-temperature zone, the temperature of which exceeds 2,000° C., in the combustor, during combustion of the fuel.

Various combustion systems are being investigated to solve the problem of the gas turbine combustor. For example, a catalytic combustion system using a solid phase catalyst has been proposed, in which such thin fuel as cannot be combusted in an ordinary combustor can be ignited. Therefore, with this system, the combustion temperature is not as high as the temperature which produces NOx and the turbine inlet temperature is as high as that of a conventional combustor.

The catalytic combustion type combustor has as a structural feature an auxiliary fuel injection nozzle and a catalyst body, arranged in series at the downstream side of the fuel injection nozzle with respect to the combusted gas flow passage. In general, the catalyst body has a honeycomb structure in which the mixture of fuel and air is combusted.

However, this catalytic combustion type combustor is also accompanied by the following problems. In the gas turbine, the temperature of the combustion gas to be injected into the turbine must be approximately 1,100° C. and will tend to be much higher so that a higher efficient can be obtained. When the gas mixture is combusted at such a high temperature, however, the catalyst itself is heated to a temperature higher than 1,100° C., with the result that the catalyst body tends to be broken. Through the experiments made by the inventors of this invention, it was confirmed that the temperature of the catalyst body was raised up to 1,100° ~ 1,300° C. In spite of this problem, a catalyst which withstands a temperature from 1,100° to 1,300° C. has not yet developed.

The inventors of this invention have proposed, as disclosed in U.S. Pat. No. 4,731,989, a catalytic combustion method which reduces the heat load exerted on a catalyst body by effectively utilizing the gas-phase combustion occurring on the downstream side of the catalyst body, in a combustor. According to this method, a diluent mixture gas of fuel and air is combusted at the catalyst body. Generally, when a diluent gas mixture which is not easily burnt is oxidized by using the catalytic body, contact combustion (catalytic combustion) on the surface of the catalyst occurs simultaneously with gas-phase combustion in the honeycomb structure. According to the above-mentioned method, however, the density, temperature and flow rate of the mixture gas are controlled such that only contact combustion occurs in the catalyst body. Since no gas phase combustion occurs in the catalyst body, the combustion temperature does not become high. Further, only part of the fuel is burnt, and combustion gas including the unburnt gas is exhausted from the catalyst body. As a result, the catalyst body can be prevented from being damaged by heat.

According to this proposal, new fuel, supplied from a fuel supply pipe provided downstream from the catalyst body, is added to the combustion gas exhausted from the catalyst body. Accordingly, the fuel density in the combustion gas is increased to induce gas-phase combustion on the downstream side of the catalyst body, thereby raising the temperature of the combustion gas to be supplied into the gas turbine. Normally, the gas-phase combustion on the downstream side of the catalyst body occurs at the thin mixing ratio side, to suppress the generation of NOx.

However, this proposed catalytic combustion method is faced with the following problem:

When high density fuel, which is not mixed with air, is delivered from the fuel supply pipe and added to the combustion gas exhausted from the catalyst body, the fuel density distribution in the combustion gas becomes uneven. In other words, an area of high fuel density and an area of low fuel density appear in the combustion gas on the downstream side of the catalyst body. Since the combustion temperature in the high fuel density area, becomes higher than in the low fuel density area, a large amount of NOx is produced there.

For solving this problem, fuel supply means must be provided on the downstream side of the catalyst body so that the fuel density distribution becomes even. A means for supplying fuel from the interior of the combustor and a means for injecting fuel from the outside of the combustor are considered as such fuel supplying means.

The former means more easily equalizes the fuel density distribution than the later one. With the former means, however, the fuel supply means is exposed to gas at a high temperature, so that it is necessary to cool the fuel supply means. This causes the structure of the combustor to become complicated and lowers the reliability of the fuel supply means under high temperature. Thus, with the former means, the above problem has not yet been solved.

With the latter means, little trouble has arisen as to the heat resistance of the fuel supply means. However, a required fuel traveling distance must be obtained in order to ensure uniform fuel density distribution. The fuel traveling distance depends greatly on the fuel pressure. When the combustor is large, it is difficult to obtain the required fuel traveling distance under regular fuel pressure.

SUMMARY OF THE INVENTION

The present invention is contrived in consideration of the above circumstances and its object is to provide a gas turbine combustor in which a catalyst body can be prevented from being damaged, fuel can be evenly supplied to combustion gas on the downstream side of the catalyst body, and the generation of NOx can be suppressed.

In order to obtain this object, a gas turbine combustor according to this invention comprises:

a main body having a combustion portion formed therein;

gas supply means for supplying a gas mixture of fuel and gas including oxide;

means for igniting the gas mixture;

catalyst means provided in the main body and on the downstream side of the gas supplying means with respect to the flow of the gas mixture, for carrying out catalytic combustion of the gas mixture;

a gas phase combustion portion provided in the main body and on the downstream side of the catalyst means, for carrying out gas phase combustion of the gas mixture including gas burned by the catalyst means;

dividing means provided between the catalyst means and the gas phase combustion portion, having a plurality of independent branch passages, for dividing the gas mixture passed through the catalyst means into a plurality of gas flow branches; and fuel supply means for supplying fuel into each branch passage.

With the combustor as constructed above, the gas mixture supplied from the gas supplying means is burned through a catalytic reaction by the catalyst means and flows in the branch passages as combustion gas. The combustion gas flowing into each branch passage is mixed with fuel supplied from the fuel supply means and is conducted to the gas phase combustion portion to be burned in a gas phase. Accordingly, the catalytic combustion occurs at a relatively low temperature in the catalyst means, thereby preventing the catalyst means from being damaged by heat. In the gas phase combustion portion, the mixed gas is completely combusted in a gas phase.

Further, fuel is supplied from the fuel supply means to the combustion gas flowing through each of the branch passages. Thus, a sufficient fuel traveling distance is ensured in each branch passage and the fuel is completely mixed with the combustion gas. As a result, the fuel density distribution in the combustion gas to be supplied to the gas phase combustion portion can be uniform, thereby being able to perform gas phase combustion in which a minimum of NOx is produced.

It is desired that the combustor of this invention be provided with cooling means for cooling the dividing means. The cooling means cools those regions of the dividing means which are exposed to the catalytic combustion and the gas phase combustion, resulting in the enhancement of the durability of the dividing means.

BRIEF DESCRIPTION OF THE DRAWINGS

FIGS. 2 to 4 show a gas turbine combustor according to a first embodiment of this invention, in which FIG. 2 is a longitudinal cross-sectional view of the combustor, FIG. 3 is an enlarged longitudinal cross-sectional view of a dividing unit, and FIG. 4 is a cross-sectional view along line II—II of FIG. 2;

FIGS. 7 to 10 show a gas turbine combustor according to a second embodiment of this invention, in which FIG. 7 is a longitudinal cross-sectional view of the combustor, FIG. 8 is an enlarged longitudinal cross-sectional view of a dividing unit, FIG. 9 is a perspective view of the dividing unit of FIG. 8, and FIG. 10 is a cross-sectional view along line X—X of FIG. 8;

DETAILED DESCRIPTION OF THE PREFERRED EMBODIMENTS

Embodiments of this invention will be described in detail with reference to the accompanying drawings.

Figure 1:
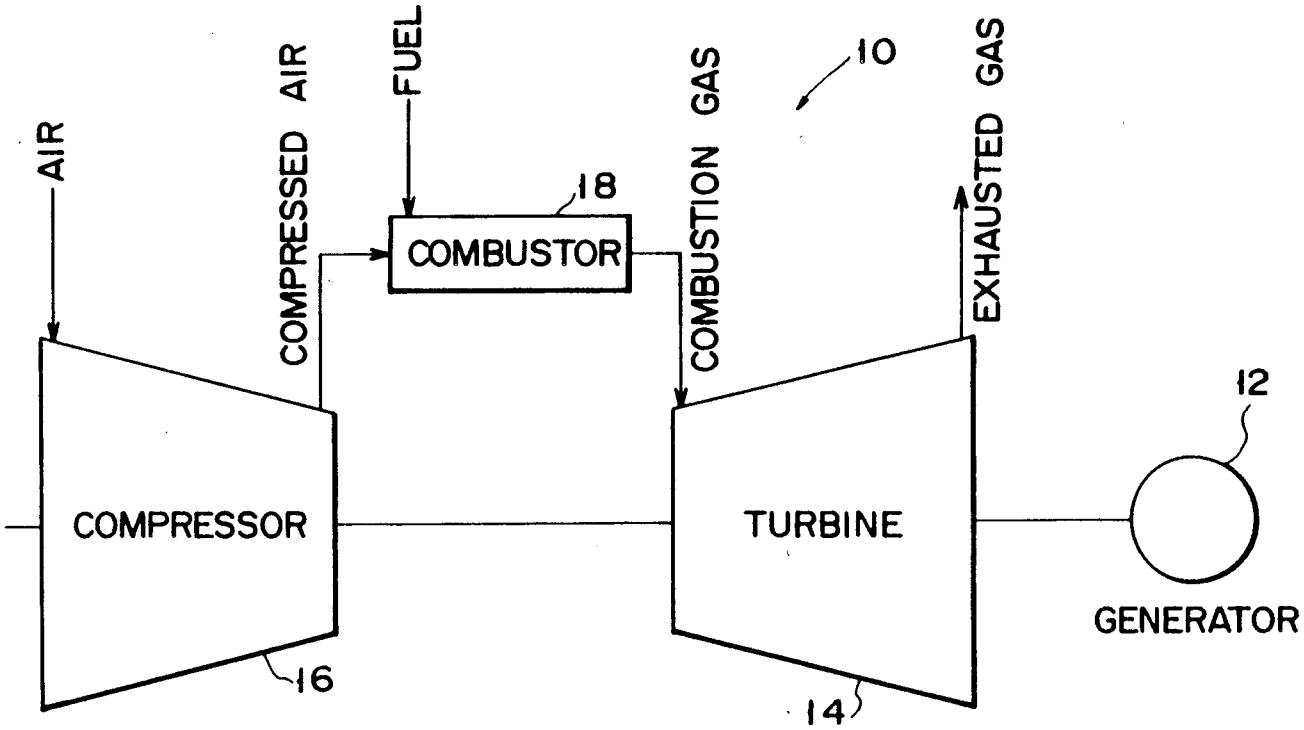
FIG. 1 is a schematic view showing a whole power electric generating system provided with a gas turbine combustor according to this invention.
Figure 10:
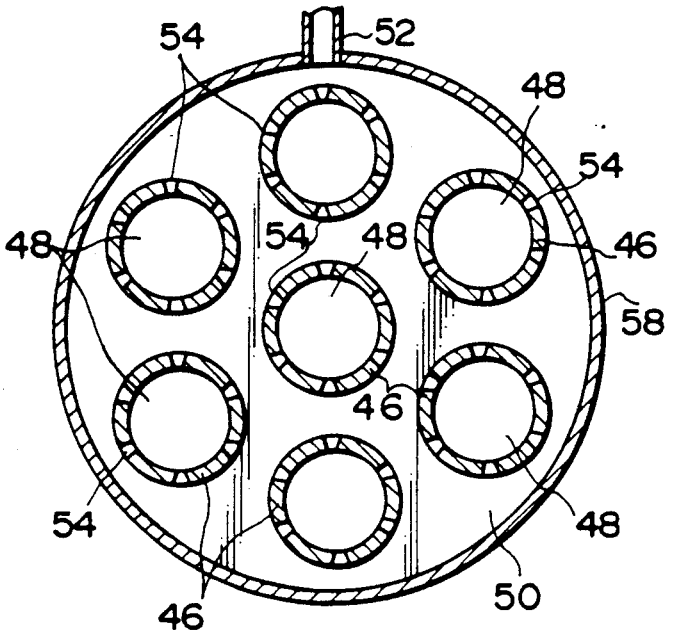
Figure 11:
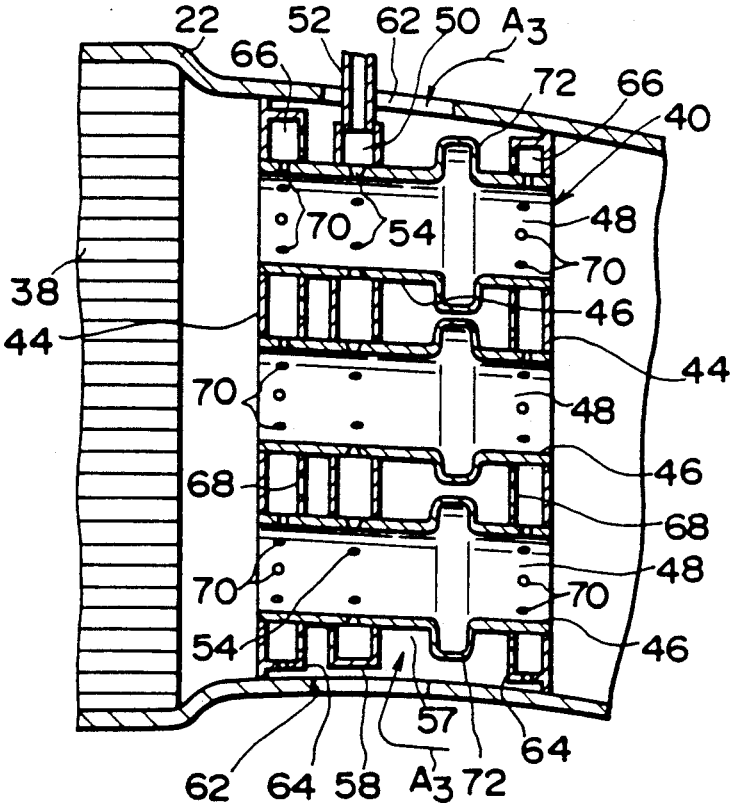

FIG. 1 schematically shows an entire power generating system 10 provided with a gas turbine combustor according to this invention. The system 10 comprises a turbine 14 connected to an electric generator 12, and a compressor 16. Compressed air supplied from the compressor 16 is used for combustion cooling in the combustor. The combustor is adapted to burn the mixture of compressed air and fuel and to supply the combustion gas to the turbine 14. The turbine 14 is rotated to drive the generator 12.

Figure 2:
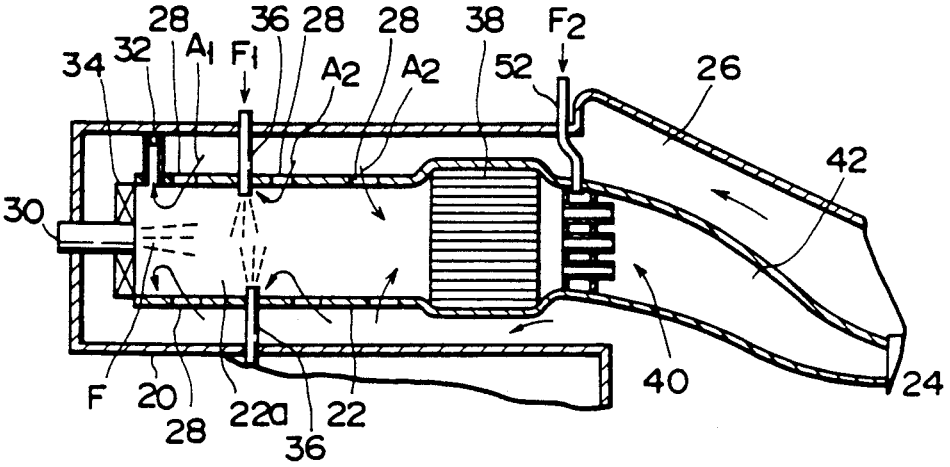

As is shown in FIG. 2, the gas turbine combustor is provided with an outer cylinder 20 and an inner cylinder 22 located within the outer cylinder 20. The inner cylinder 22 has one end closed and the other end communicating with the interior of the turbine 14 via a turbine nozzle 24. Similarly, the outer cylinder 20 has one end closed and the other end connected to the compressor 16. Therefore, the space between the inner cylinder 22 and the outer cylinder 20 defines an air supply passage 26 through which compressed air, which acts as air for combustion and cooling, is supplied to the inner cylinder 22.

A combustion portion 22*a* is defined in the closed end portion of the inner cylinder 22 and communicates with the air supply passage 26 through many air supply holes 28 formed in the circumferential wall of the inner cylinder. To the closed end wall of the inner cylinder 22 is connected a fuel injection nozzle 30 for supplying fuel such as natural gas F to the combustion portion 22*a*. The nozzle 30 penetrates the outer cylinder 20 and extends outwards from the combustor. An ignition plug 32 is provided on the closed end portion of the inner cylinder 22. The fuel F jetted from the nozzle 30 is mixed with combustion air A1 flowing into the combustion portion 22*a* through the supply holes 28. The gas mixture is ignited by the ignition plug 32 and is precombusted in the combustion portion. The nozzle 30 is surrounded by a swirler 34 for swirling the fuel F and the air A1 and stabilizing the combustion. However, precombustion is unnecessary for some fuel or when some catalysts, as described later, are used.

Auxiliary fuel injection nozzles 36 which inject fuel F1 to the combustion portion 22*a* are arranged circumferentially on that portion of the peripheral wall of the inner cylinder 22 which is separate from the nozzle 30, towards the turbine nozzle 24, that is, located on the downstream side of the nozzle 30. The nozzles 36 extend externally from the combustor through the outer cylinder 20. The fuel F1 jetted from the nozzles 36, as well as the combustion air A2 supplied through the supply holes 28 to the combustion portion, are added to the pre-combusted gas mixture and form a new gas mixture. A catalyst body 38 made of noble metal having a honeycomb structure is provided on the downstream side of the auxiliary nozzles 36 in the inner cylinder 22. The new gas mixture is supplied to the catalyst body 38, where it is burned through catalytic reaction.

Figure 3:
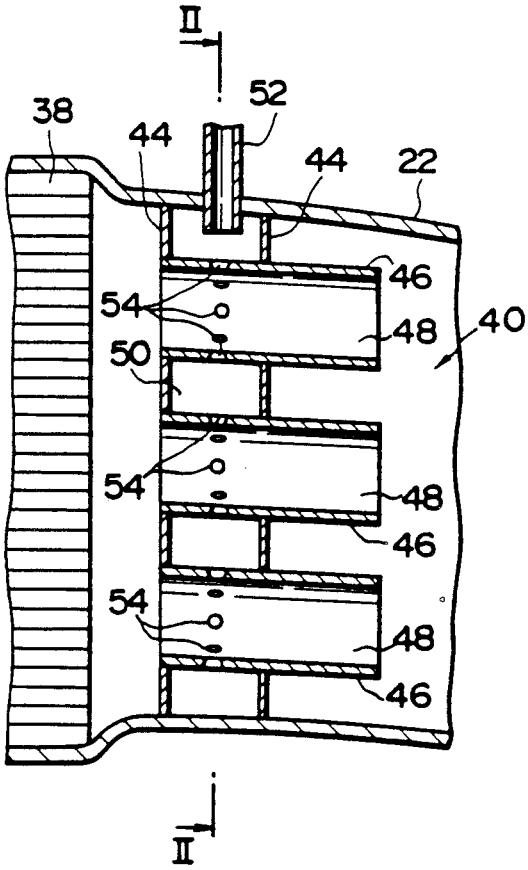
Figure 4:
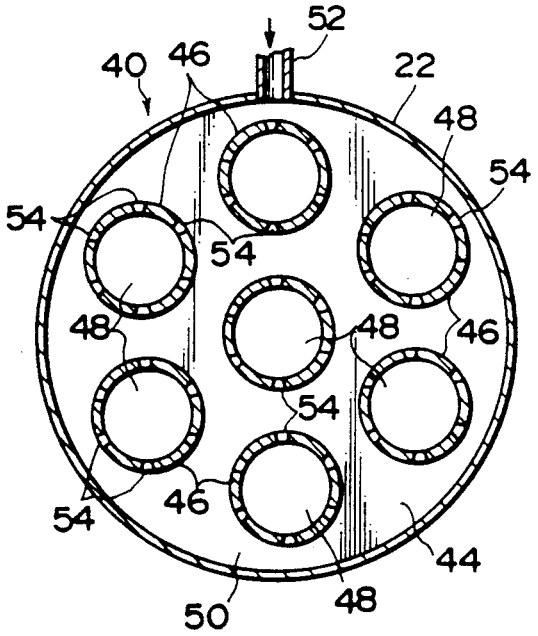
Figure 2:
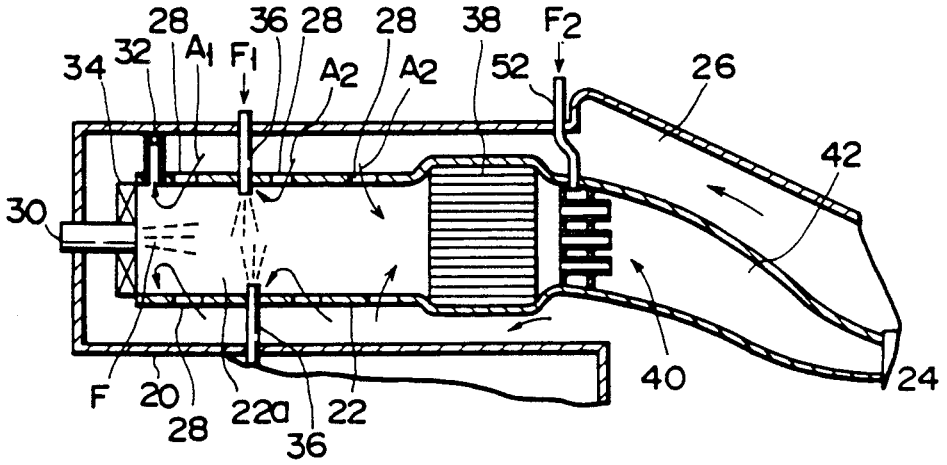
Figure 3:
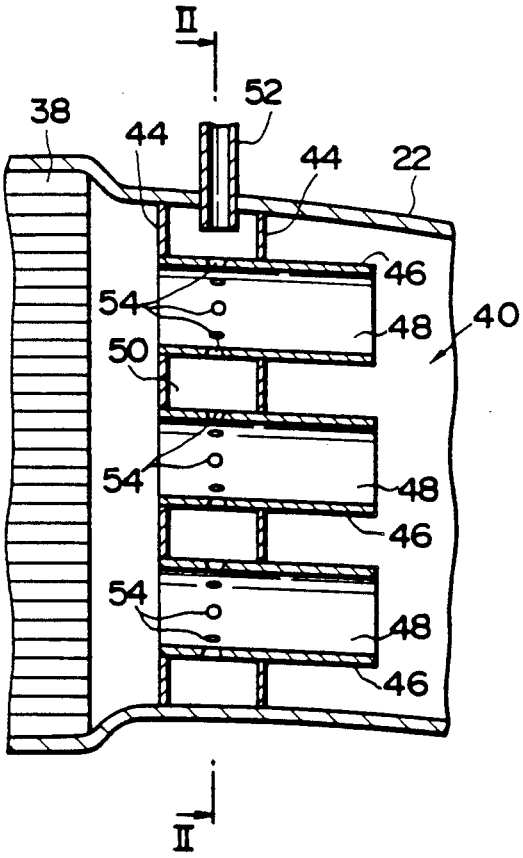
Figure 4:
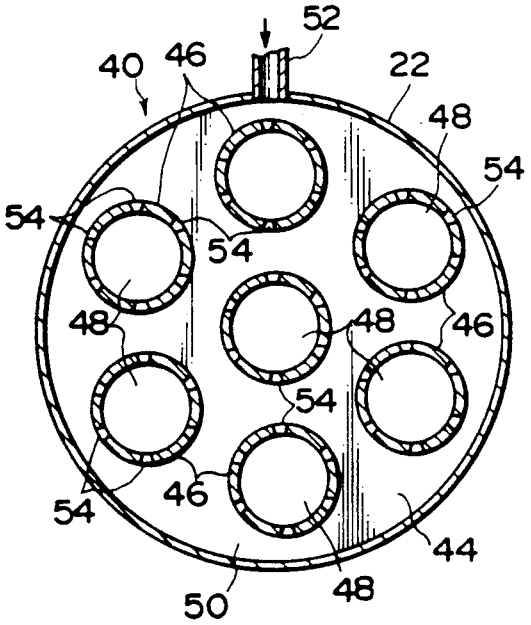

A dividing unit 40 is provided on the downstream side of the catalyst body 38 in the inner cylinder 22, and a gas phase combustion portion 42 is formed on the downstream side of the unit. As is shown in FIGS. 2 to 4, the dividing unit 40 has a pair of parallel partition walls 44 which are fixed to the inner circumferential face of the inner cylinder 22 so as to block the passage of the combustion gas. The unit 40 includes a plurality of cylindrical pipes 46 (seven pipes in the embodiment) supported by the walls 44. Each pipe 46 extends in the direction of the combustion gas flow or along the axis of the inner cylinder 22. Each pipe 46 has one end opened at the partition wall 44 opposed to the catalyst body 38 and the other end penetrating the other partition wall 44 and opening onto the gas phase combustion portion 42. By these cylindrical pipes 46 are defined a plurality of branch passages 48 which introduce the combustion gas passed through the catalyst body 38 into the gas phase combustion portion 42.

As is seen from FIG. 4, one of the pipes 46 is provided at substantially the center of the partition wall 44 and the other pipes 46 are arranged equidistantly in the circumferential direction so as to surround the central pipe 48. By the two partition walls 44 and the inner circumferential face of the inner cylinder 22 is defined a fuel distribution chamber 50 which surrounds the upstream end portion of each cylindrical pipe 46. The distributing chamber 50 communicates with a fuel supply tube 52 extending through the outer cylinder 20 and also communicates with the branch passages 48 through a plurality of nozzle holes 54 formed in the periphery of the pipes 46. The nozzle holes 54 of each pipe 46 are arranged equidistantly in the circumferential direction of the pipe 46. The fuel F2 supplied from fuel supply tube 52 into the fuel distribution chamber 50 is delivered to the branch passages 48 through the nozzle holes 54, thus being mixed with the gas mixture flowing through the branch passages.

The fuel F2 supplied to the branch passages 48 may be pure fuel or a mixture of fuel gas and air. The number, diameter and shape of the cross section of the branch passages 48 and the number and diameter of the nozzle holes 54 are determined depending on fundamental factors such as the flow rate, speed and properties of the gas passed through the catalyst body 38, and the pressure and flow rate of the fuel F2. In this case, it is preferred that the number and size of the pipes 46 are determined so that the traveling distance of the fuel F2 injected from each nozzle hole 54 is more than half the diameter of the branch passage 48.

The space between the adjacent cylindrical pipes 46 in the chamber 50, or so-called dead space, prevents the combustion gas passed through the catalyst body 38 from flowing into the branch passages 48, thereby increasing the pressure loss of the gas. For this reason, the arrangement and the cross sectional shape of the cylindrical pipes 46 is determined depending on the allowable pressure loss of fuel in the distributing chamber 50. The positions in which the nozzle holes 54 and the fuel supply tube 52 are provided are not always limited, but it is preferred that they be arranged as close as possible to the catalyst body in order to effectively mix the gas mixture passed through the catalyst body 38 with the fuel jetted from the nozzle holes 54.

The operation of the gas turbine combustor constructed as above will now be explained.

Referring to FIG. 2, the fuel F jetted from the fuel injection nozzle 30 to the combustion portion 22*a* is mixed with the air A1 flowing into the combustion portion 22*a* through the air supply passage 26 and the air supply holes 28. The gas mixture is ignited by the spark plug 32 to be pre-combusted, and then mixed with the fuel F1 supplied from the auxiliary fuel injection nozzles 36 and the air A2 to form a new gas mixture, which then flows into the catalyst body 38. The temperature and amount of the pre-combusted gas and the supplied amount of the fuel F1 and air A2 are adjusted so as to obtain a diluent gas mixture such that the working temperature of the catalyst body 38 is stably held and a suitable temperature, which is lower than the temperature at which the catalyst body is broken, is maintained.

In the catalyst body 38, the gas mixture is burned through a catalytic reaction. Since the catalytic combustion is incomplete combustion, the combustion gas exhausted from the catalyst body 38 contains unburnt fuel. However, the unburnt fuel does not cause trouble, because it is completely combusted in the gas phase combustion portion 42. Thus, the temperature of the catalyst body 38 is not raised to a high level, thereby preventing deterioration and damage of the catalyst body.

The combustion gas exhausted from the catalyst 38 flows into a plurality of branch passages 48 of the dividing unit 40 and is divided into a plurality of gas streams. While the combustion gas flows through the branch passages 48, it is mixed with new fuel F2 supplied from the nozzle holes 54 thereby producing another new gas mixture. The gas mixture flows into the gas phase combustion portion 42 and is burned completely. Since the fuel F2 is supplied to each of the combustion gas streams divided by the dividing unit 40, the fuel density of the gas mixture flowing into the gas phase combustion portion 42 is kept uniform in the overall area. Therefore, the generation of NOx is effectively suppressed during the combustion of the gas mixture in the gas phase combustion portion 42. Then, the combustion gas heated to a predetermined temperature is jetted from the turbine nozzle 24 into the interior of the gas turbine 14.

With the above described gas turbine combustor, the dividing unit 40 having a plurality of branch passages 48 and the fuel supply means for supplying fuel to the branch passages are provided between the catalyst body 38 and the gas phase combustion portion 42. The combustion gas exhausted from the catalyst body 38 is divided by the unit 40 into a plurality of gas streams, and new fuel is added to the gas in each stream. In this way, the combustion gas from the catalyst body 38 is mixed with the newly supplied fuel in narrow spaces, that is, in branch passages 48, enabling the fuel density distribution of the gas mixture supplied to the gas phase combustion portion 40 to remain uniform over all regions of the gas mixture. This effectively suppresses the generation of NOx during the gas phase combustion of the gas mixture.

Figure 5:
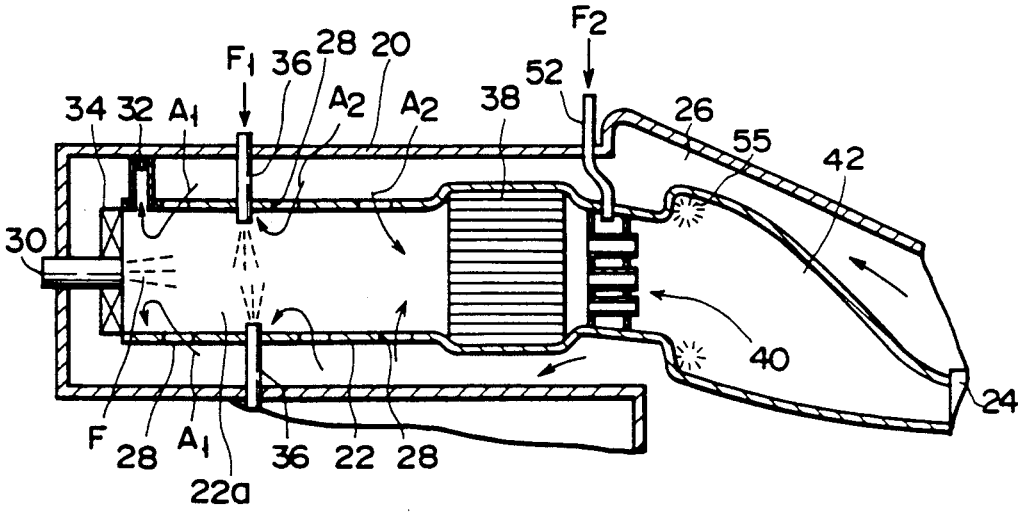
FIG. 5 is a longitudinal cross-sectional view showing a first modification of the first embodiment of the combustor.

As is shown in FIG. 5, in the first embodiment, the inner cylinder 22 defining the gas phase combustion portion 42 may be provided with an expanded portion 55 at the vicinity of the dividing unit 40 such that the portion 55 causes the timing of the flow of the gas mixture to be delayed or to cause the gas mixture to flow reversely. Part of the gas mixture flowing into the gas phase combustion portion 42 is turned back into the expanded portion 55 to form a flame holding portion, thereby allowing stable gas phase combustion. Further, part of the gas mixture flowing out of the branch passages 48 is turned back toward the partition plate 44 to form flame holding portions, so that gas phase combustion can be stably performed.

Figure 6:
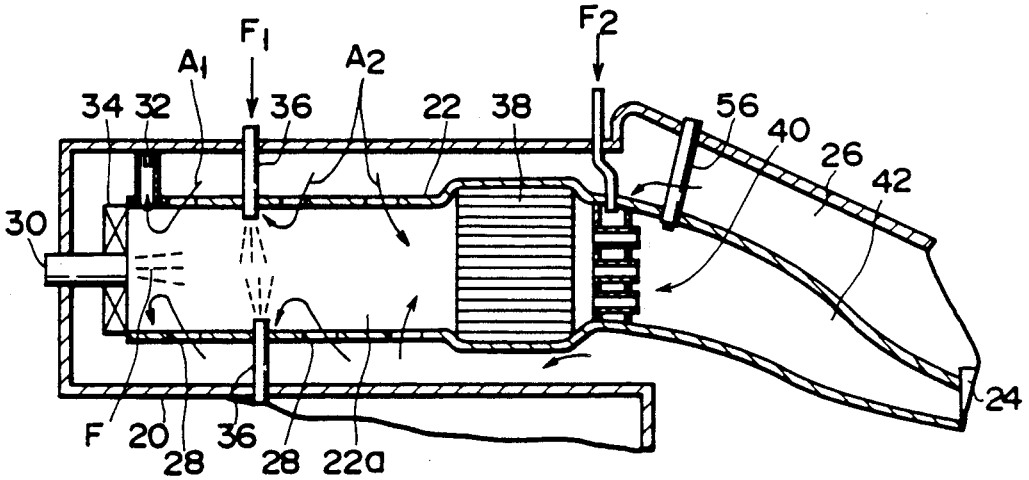
FIG. 6 is a longitudinal cross-sectional view showing a second modification of the first embodiment of the combustor.

As is shown in FIG. 6, an igniting source 56 such as an ignitor may be provided on the downstream side of the dividing unit 40. In this case, the gas phase combustion starts easily and the combustor is effectively operated.

EXPERIMENT A

The inventors of this invention manufactured a gas turbine combustor having the structure shown in FIG. 6 and studied its combustion characteristics. The diameter of the flow passage in the catalyst body was 300 mm; the diameter of each branch passage, 81 mm; and the number of branch passages, 7. A honeycomb catalyst body of noble metal having a diameter of 300 mm and a length of 150 mm was used as the catalyst body 38.

The mixture (temperature about 450° C.) of the natural gas F1 and air (A1+A2, which are mixed with each other at a volume ratio of F1/(A1+A2) as listed below, was supplied to the catalyst body 38 at a flow rate of 30 m/sec when expressed at 500° C. and was burned.

The mixing ratio (F1+F2)/(A1+A2) of the gas mixture consisting of the natural gas (F1+F2), containing the natural gas F2 supplied from the fuel supply tube 52, and the burning air (A1+A2) were selected as shown in the table below, and gas phase combustion started by the ignition of an ignitor.

The combustor was operated under the abovementioned conditions, and the amount (measured in ppm) of NOx generated in the combustion gas by combustion was measured at a position separated from the catalyst body 38 by 700 mm on the downstream side thereof. The results of the measurements are shown in the table. The combustion efficiency of the combustor under each condition was 99% or more.

A combustor, in which the dividing unit 40 was omitted from the combustor shown in FIG. 6, was used as a comparative example, and the combustion tests were carried out under similar conditions. In this comparative example, eight fuel supply tubes (pin-jet type) were used, and the total amount of fuel supplied from these supplying tubes was taken as F2 upon calculating the ratio (F1+F2)/(A1+A2).

TABLE

| | $\frac{F1}{(A1+A2)}$ | $\frac{(F1+A2)}{(A1+A2)}$ | NOx (ppm) |
|---|---|---|---|
| Embodiment 1 | 0.03 | 0.05 | 4 |
| Embodiment 2 | 0.03 | 0.04 | 3 |
| Embodiment 3 | 0.02 | 0.05 | 5 |
| Embodiment 4 | 0.02 | 0.04 | 4 |
| Comparative Example 1 | 0.03 | 0.05 | 13 |
| Comparative Example 2 | 0.03 | 0.04 | 11 |
| Comparative Example 3 | 0.02 | 0.05 | 16 |
| Comparative Example 4 | 0.02 | 0.04 | 14 |

From the experimental results, it was found that the amount of NOx generated in the combustors according to the embodiment of this invention was reduced to approximately one third of that produced in the combustor used for the comparative tests.

FIGS. 7 to 10 show a gas turbine combustor according to a second embodiment of this invention. The structure of this embodiment is the same as that of the first embodiment except that the dividing unit 40 is equipped with a cooling mechanism. The same parts and portions as those of the first embodiment are denoted by the same reference numerals, an explanation thereof being omitted.

As shown in FIGS. 7 to 10, a pair of parallel partition walls 44 are spaced apart from each other by a distance equal to the length of each cylindrical pipe 46 and are fixed to the inner circumferential face of an inner cylinder 22 in an air-tight state. Both ends of each pipe 46 are fixed to the corresponding partition walls 44 by welding or the like, and are opened at the partition walls 44. In a cooling space 57, defined between the two partition walls 44, is arranged a jacket 58 having a hollow disc shape with a diameter slightly smaller than that of the inner cylinder 22, so as to be parallel to the partition walls 44. Within the jacket 58 is defined a fuel distributing chamber 50 which communicates with a fuel supplying tube 52 extending through an outer cylinder 20 and the inner cylinder 22. Each cylindrical pipe 46 penetrates the jacket 58 in an air-tight fashion and its interior communicates with the fuel distributing chamber 50 through a plurality of nozzle holes 54 formed in the peripheral wall of the cylindrical pipe 46.

The dividing unit 40 is provided with a cooling mechanism 60 for mainly cooling the partition walls 44. The fundamental structure of the cooling mechanism 60 is such that the cooling air A3 is conducted from the air supply passage 26 into the cooling space 57 between the two partition walls 44, through a plurality of introducing openings 62 formed in the inner cylinder 22 and cools the dividing unit 40, and thereafter the air is introduced into branch passages 48. With this structure, areas in which it is difficult for cooling air to flow, or dead spaces, are likely to appear in the cooling space 57 in the vicinity of the partition walls 44. Since the partition walls 44 are heated by the heat radiated from a catalyst body 38 and a gas phase combustion portion 42, the dead space causes a problem, in that the partition walls are excessively heated.

In this embodiment, the cooling mechanism 60 is constructed for cooling the partition walls 44 efficiently. Specifically, disc members 64, each having a slightly smaller diameter than that of the partition walls 44, are fixed to the inner faces of the partition walls, respectively. Air distributing chamber 66 is defined between each disc member 64 and the corresponding partition wall 44. Both end portions of each cylindrical pipe 46 penetrate the corresponding disc members 64 and distributing chambers 66 in an air-tight state. Each distributing chamber 66 communicates with the cooling space 57 through a number of through holes 68 formed in the disc member 64, and also communicates with the branch passages 48 through plurality of nozzle holes 70 formed in the cylindrical pipes 46. In this case, the nozzle holes 70 are arranged equidistantly in the circumferential direction in the peripheral wall of each cylindrical pipe 46. In this arrangement, the cooling air A3, introduced into the cooling space 57, flows into the air distributing chambers 60 through the through holes 68, and after cooling the partition walls 44 and pipes 46, it is supplied to the branch passages 48.

According to the second embodiment having the above structure, the combustion gas exhausted from the catalyst body 38 flows into the branch passages 48 of the dividing unit 40 and is divided into a plurality of gas streams, and these gas streams are is mixed with the fuel F2 supplied through the fuel supply tube 52, fuel distributing chamber 50 and nozzle holes 54, to form a new gas mixture. The gas mixture is delivered to the gas phase combustion portion 42 and completely burned there.

The cooling air A3 introduced into the dividing unit 40 through the introducing openings 62 contacts the cylindrical pipes 46 and cools them externally, then flows into the air distributing chambers 66 through the through holes 68. The air in the distributing chambers 66 cools the partition walls 44 and then flows into the branch passages 48. Thereafter, it acts as burning air. The air conducted into the branch passages 48 performs a film-cooling as it flows along the inner surfaces of the cylindrical pipes 46 thus cooling the same internally.

Since diluent gas mixture is burned in the gas phase combustion portion 42, the combustibility is lowered there when too much cooling air is supplied thereto. Therefore, it is desired that the amount of the cooling air to be introduced into the portion 42 be limited to such an amount that is necessary to cool the dividing unit 40 only. For example, when a heat-insulating layer made of ceramic material or the like is formed on the inner face of each cylindrical pipe 46, it is possible to reduce the amount of cooling air to be introduced. Further, in order to reduce the amount of cooling air, a heat-insulating layer may be formed on the partition wall 44 located on the upstream side of the unit 40.

With the second embodiment of the combustor, the fuel density distribution of the gas mixture supplied to the gas phase combustion portion 42 is uniform within the whole range of the portion 42, as in the first embodiment, thereby effectively suppressing the generation of NOx during the gas phase combustion. Further, the cooling mechanism 60 cools every part of the dividing unit 40 or the partition walls 44 and the cylindrical pipes 46, thereby preventing the unit 40 from being damaged by heat. Accordingly, it is unnecessary to consider the heat resistance of the dividing unit 40, and the unit 40 can be manufactured at a low cost.

Figure 11:
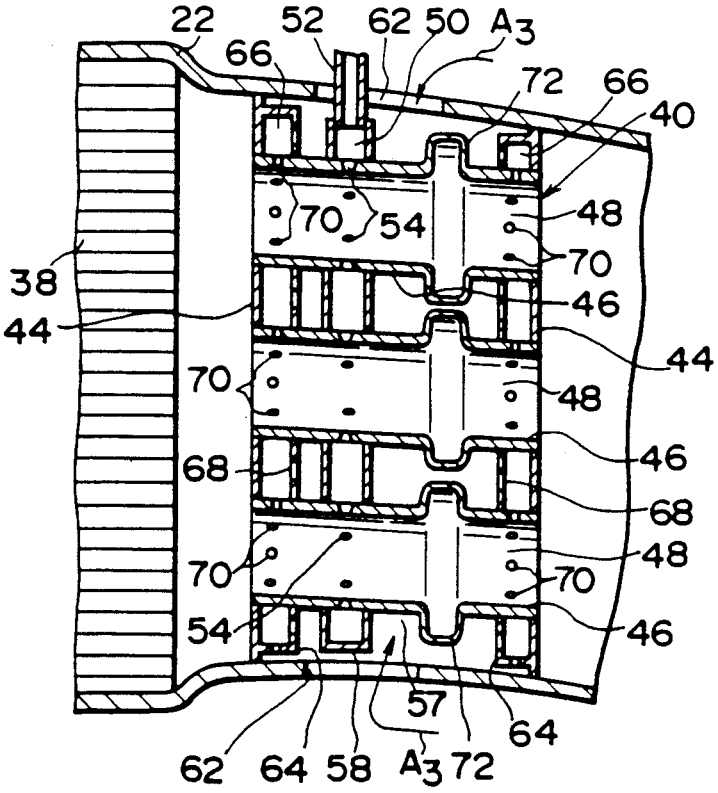
FIG. 11 is a longitudinal cross-sectional view showing a modification of the dividing unit of the second embodiment.

In the second embodiment, each cylindrical pipe 46 of the dividing unit 40 expands thermally during combustion. In order to absorb the thermal expansion, each pipe 46 may be provided with bellows 72 at an intermediate portion thereof, as is shown in FIG. 11. In this case, even when the temperature distribution in a cross-sectional area of the combustor is not uniform, with the result that the amount of thermal expansion of each of the cylindrical tubes 46 differs from the others, the dividing unit 40 is prevented from being distorted, and the reliability of the combustor is improved.

Figure 12:
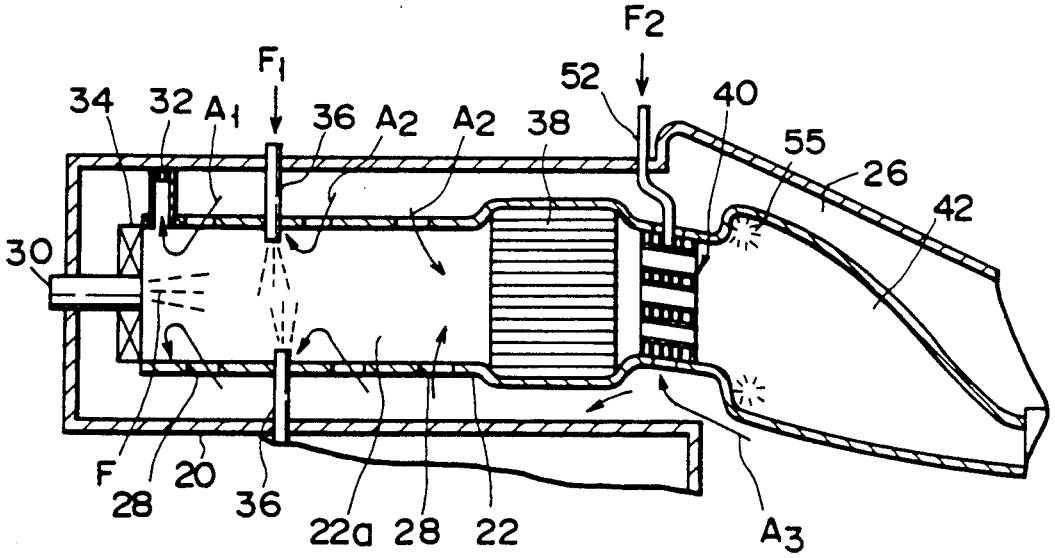
FIG. 12 is a longitudinal cross-sectional view showing a further modification of the gas turbine combustor according to the second embodiment of this invention.

In the second embodiment, the ignitor provided as a igniting source 56 in the gas phase combustion portion 42 may be omitted. As is shown in FIG. 12, an expanded portion 55 forming a flame holding portion may be provided at the inner cylinder 22, in place of the igniting source 56.

The inventors of this invention manufactured a gas turbine combustor having the structure as shown in FIGS. 7 to 10 and made combustion tests under the same conditions as those set for Experiment A. From the tests, similar combustion characteristics to those of Experiment A were obtained. In Experiment A, there were some cases in which the temperature of the cylindrical pipes of the dividing unit 40 was above 800° C., whereas it was found with the second embodiment that the temperature of the cylindrical pipes was kept at 700° C. or less.

What is claimed is:

1. A gas turbine combustor comprising:

a main body having a combustion chamber formed therein;

gas supply means for supplying a gas mixture of fuel and gas including oxide to the combustion chamber;

igniting means for igniting the gas mixture;

catalyst means arranged in the main body on the downstream side of the gas supply means with respect to the flow of the gas mixture, for burning the gas mixture through a catalytic reaction;

a gas phase combustion portion provided in the main body on the downstream side of the catalyst means, for carrying out gas phase combustion of the gas mixture containing combustion gas burned in the catalyst means;

dividing means arranged in the main body between the catalyst means and the gas phase combustion portion and having a plurality of independent branch passages extending therebetween, for dividing the gas mixture passed through the catalyst means into a plurality of gas streams which flow through the branch passages, said dividing means including a first partition wall arranged in the main body and opposed to the catalyst means so as to block the flow path of the gas mixture passed through the catalyst means, a second partition wall arranged in the main body on the downstream side of the first partition wall so as to oppose thereto, and a plurality of pipes extending through the first and second partition walls, each of which defines a branch passage;

cooling means for cooling the dividing means, said cooling means including a cooling space defined between the first and second partition walls and surrounding pipes, and inlets opened to the cooling space, for introducing cooling air into the cooling space; and fuel supply means for supplying fuel to the branch passages.

2. A combustor according to claim 1, wherein each of said pipes has one end opened at the first partition wall and the other end extending from the second partition wall into the gas phase combustion portion.

3. A combustor according to claim 1, wherein said gas phase combustion portion is provided with second igniting means for igniting the gas mixture passed through the dividing means.

4. A combustor according to claim 3, wherein said second igniting means has a flame holding portion formed in the gas phase combustion portion.

5. A combustor according to claim 4, wherein said gas phase combustion portion has an expanded portion located in the vicinity of the dividing means and forming said flame holding portion.

6. A combustor according to claim 1, wherein said cooling means includes a partition member provided in the cooling chamber and defining an air distributing chamber which contacts at least one of the first and second partition walls and through which the pipes penetrate in an air-tight state, a plurality of through holes formed in the partition member, for introducing cooling air in the cooling space into the air distributing chamber, and a plurality of air nozzle holes formed in the pipes, for introducing cooling air from the air distributing chamber into the branch passages.

7. A combustor according to claim 6, wherein said cooling means has a second air distributing chamber having a similar structure to said air distribution chamber and contacting the other one of said first and second partition walls.

8. A combustor according to claim 1, wherein said fuel supply means includes a fuel distributing chambers which is defined in the cooling space and through which said pipes penetrate in an air-tight state, a fuel supply tube for supplying fuel into the fuel distributing chamber, and a plurality of nozzle holes formed in said pipes and causing the fuel distributing chamber to communicate with the branch passages.

9. A combustor according to claim 8, wherein each of said pipes has one end opened at the first partition wall and the other end opened at the second partition wall.

10. A combustor according to claim 8, wherein said first and second partition walls are formed substantially circular, and one of said pipes is located substantially coaxially with the partition walls, and the other pipes are arranged around said one pipe and equidistant from each other in the circumferential direction of the partition walls.

11. A combustor according to claim 10, wherein each of said pipes has a circular cross section, and said nozzle holes are arranged equidistant from each other along the circumference of the pipes.

12. A combustor according to claim 1, wherein said dividing means includes means for absorbing axial thermal expansion of each of said pipes.

13. A combustor according to claim 12, wherein said absorbing means has a bellows formed at an intermediate portion of each pipe.

* * * * *

UNITED STATES PATENT AND TRADEMARK OFFICE
CERTIFICATE OF CORRECTION

PATENT NO. : 5,000,004

DATED : Mar. 19, 1991

INVENTOR(S) : Susumu Yamanaka, et al.

It is certified that error appears in the above-identified patent and that said Letters Patent is hereby corrected as shown below:

IN THE DRAWINGS:

FIGS. 2-4 should be deleted from Sheet 1 of 7 and substitute FIG. 1, as shown on Sheet 5 of 7.

Figure 10:
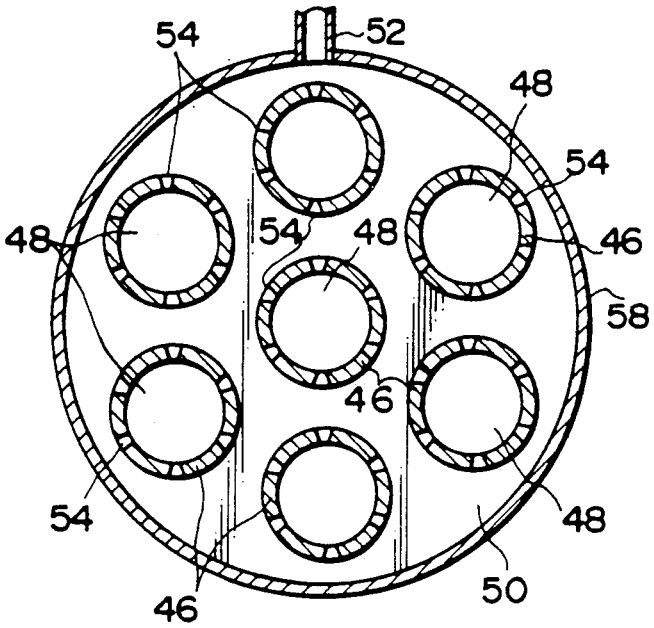

FIGS. 10 and 11 should be deleted from Sheet 3 of 7 and substitute FIGS. 5 and 6, as shown on Sheet 7 of 7.

Figure 7:
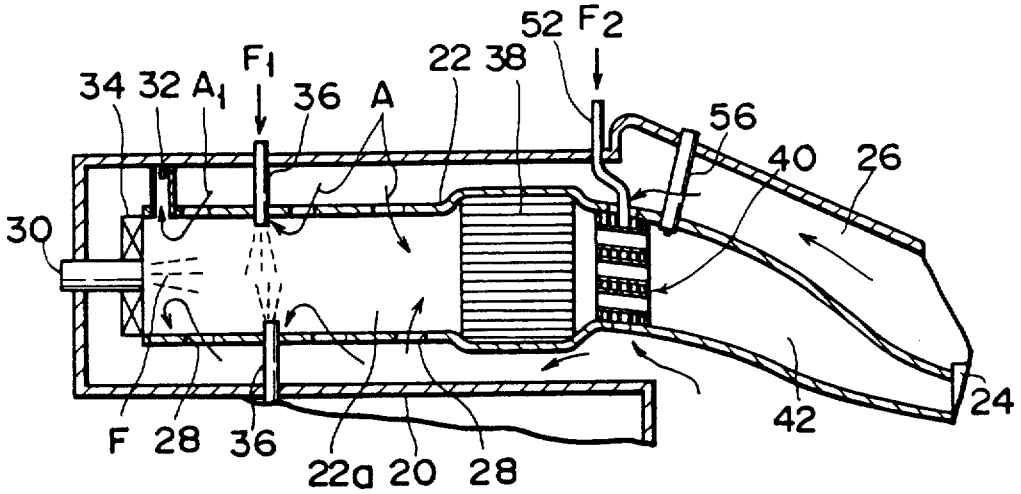

Substitute FIG. 7, as shown on the attached page, for FIG. 12 shown on Sheet 4 of 7.

Figure 8:
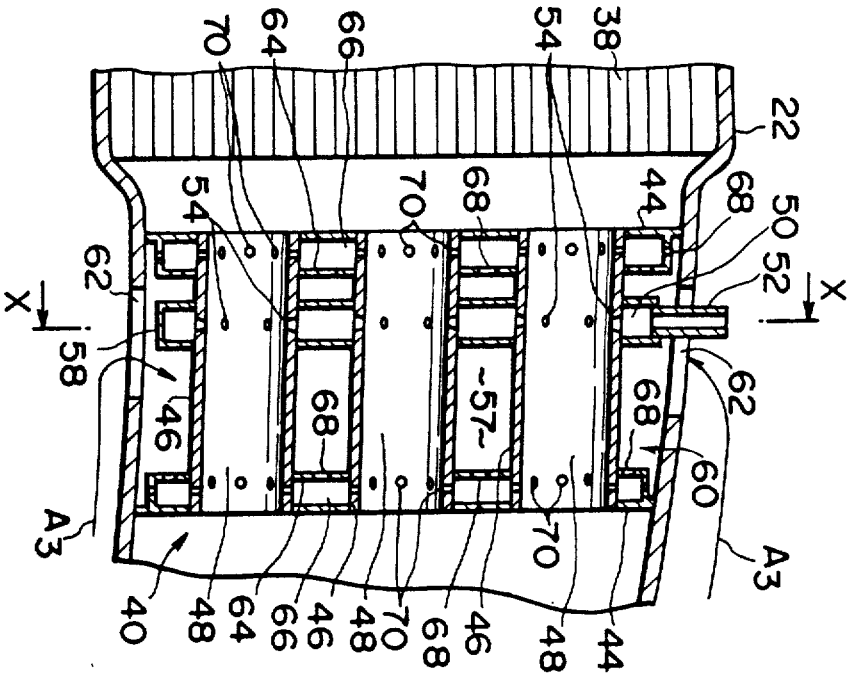
Figure 9:
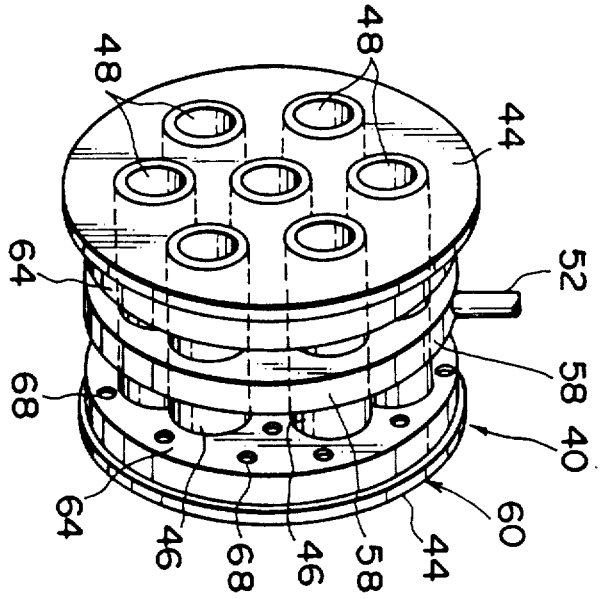

Substitute FIGS. 8 and 9, as shown on the attached page, for FIG. 1 shown on Sheet 5 of 7.

Substitute FIG. 12, as shown on Sheet 4 of 7, for FIGS. 5 and 6 shown on Sheet 7 of 7.

Signed and Sealed this

Twenty-fourth Day of December, 1991

*Attest:*

HARRY F. MANBECK, JR.

*Attesting Officer* *Commissioner of Patents and Trademarks*